United States Patent [19]

Tong

[11] 4,350,407

[45] Sep. 21, 1982

[54] SAFETY LAMP PLUG

[75] Inventor: George K. K. Tong, Hong Kong, Hong Kong

[73] Assignees: Tung Ming Electrical Co. Ltd., Taipei, Taiwan; Chane Hwa Manufacturing Co. Ltd., Kowloon, Hong Kong

[21] Appl. No.: 152,491

[22] Filed: May 22, 1980

[51] Int. Cl.[3] ..... H01H 85/32; H01H 85/24; H01R 3/00

[52] U.S. Cl. ..... 339/113 L; 337/262; 337/266; 339/147 P

[58] Field of Search ..... 339/143, 113 R, 113 L, 339/147 P, 147 R; 337/266, 262, 242, 255, 253, 197, 198

[56] References Cited

U.S. PATENT DOCUMENTS

| | | | |
|---|---|---|---|
| 1,990,176 | 2/1935 | Fried | 337/197 |
| 2,030,016 | 2/1936 | McIntosh . | |
| 2,649,522 | 8/1953 | Marcus . | |
| 2,668,885 | 2/1954 | Geruat . | |
| 2,808,485 | 10/1957 | Cardone . | |
| 3,184,569 | 5/1965 | McLaren | 337/266 |
| 3,833,875 | 9/1974 | Holoka | 337/198 |
| 3,953,099 | 4/1976 | Wilson | 339/113 R |
| 3,976,967 | 8/1976 | Magherini | 339/147 P |
| 4,030,059 | 6/1977 | Tong | 337/262 |
| 4,080,039 | 3/1978 | Ahroni | 339/147 R |

*Primary Examiner*—Stephen G. Kunin
*Assistant Examiner*—Robert A. Rose
*Attorney, Agent, or Firm*—Kalish & Gilster

[57] ABSTRACT

A fused plug constituting a safety lamp plug is provided for use with a light string set. A molded plastic body of the plug is formed of joined halves which define a first pair of compartments. Electrodes within such compartments define prongs extending from the body and blades within the body for receiving prongs of an add-on plug. Provided also within the molded body are a pair of compartments, each containing a safety lamp. Each safety lamp is a fuse lamp having a filament normally providing illumination but constituting a fusible element which melts upon current overload. The prong-defining electrodes are each interconnected with one lead of respective fuse lamp. The other lead of each fuse is interconnected with conductors for providing electrical power to the light string set. The fuse lamps are readily removable and illumination from them can be seen from outside the plug for determining their proper operation.

3 Claims, 9 Drawing Figures

SAFETY LAMP PLUG

BACKGROUND AND SUMMARY OF THE INVENTION

The present invention relates to a fused plug, and more particularly, to such a plug constituting a safety lamp plug, and intended for providing fusing of light string sets.

Light string sets of the type utilized for decorative purposes, and particularly the type having miniaturized incandescent lamps, typically are manufactured with relatively small gauge insulated wire. For protecting such string sets against short circuits and to provide the sets adequately with intrinsic safety for permitting their approval by safety rating authorities or organizations, as well as to comply with various electrical codes, it is desirable to provide fusing for the sets. It has heretofore been proposed to utilize various conventional fuses in various ways as a part of the light string set, including placing fuse lamps within the end sockets of a series circuit string for protecting lamps between the ends of the string. Such an arrangement is disclosed in U.S. Patent Application Ser. No. 939,974, now U.S. Pat. No. 4,223,248, of George Kwo Kiun Tong, entitled "Fused Light String Set".

It has also been proposed to incorporate conventional cartridge fuses with the body of the plug of such a set. However, certain operational and economic disadvantages have resulted from such configurations. For example, cartridge fuses have required metallic contacts in the plug at each end of the fuse which add to the cost and the associated labor in manufacturing the plug. Furthermore, conventional cartridge fuses have been known to explode when a high current passes through them, such as may result from a short circuit. Also, they may be subject to variation in the rating tolerances so that an element of doubt exists as to the precise current at which a cartridge fuse will interrupt the circuit. Further, the design of conventional plugs in which cartridge fuses are placed side by side in a single compartment may compromise safety since the explosion of one cartridge fuse may damage the other and present the possibility of adjacent electrodes coming into contact. Another disadvantage of previous designs is that the prongs of the plug may be unreliably retained, presenting the possibility of the plug becoming broken or pulled apart during normal use. Also, some plugs employing cartridge fuses have provided unreliable electrical contact resulting in failure or intermittent operation, particularly when the plug has been dropped on a hard surface or has been exposed to weather and to temperature changes.

Another difficulty which has been encountered with prior fused plugs employing cartridge fuses is that it is difficult to design the plug in such a way that a cartridge fuse in which the fusible element has been melted by an overload or short circuit can be replaced by the consumer. There is such a risk that the consumer may replace a cartridge fuse with one of an incorrect rating that, for purposes of safety, the fused plug may be required to be sealed during manufacture. This prevent replacement of cartridge fuse in the plug. Thus, if a sealed plug incorporating fuse cartridges has operated to interrupt the circuit by melting of the fusible elements of the fuses therein, the plug must be entirely replaced or the light string set discarded. Therefore, it is desirable to design the light string set and plug in such a way that the consumer can safely replace the fuses without having to discard the plug or light string set and can easily determine which fuse requires replacement.

It is an object of the present invention to provide an improved fused plug, and more particularly, such an improved plug for use with light string set.

It is another object of the present invention to provide such an improved fused plug which incorporates fused lamps or so-called safety lamps, whereby the fused plug constitutes a safety lamp plug, and more particularly, which incorporates miniature glass-enveloped fuse lamps.

It is a further object of the present invention to provide such a fused plug incorporating fuse lamps of the character stated which are economical, which have high accuracy, and exhibit precise tolerance in operation.

It is a further object of the present invention to provide such a fused plug which is of compact configuration and small dimensions, and which operates to provide uniform, accurate, electrically reliable fusing of light string sets or like electrical loads.

A still further object of the invention is the provision of such a fused plug which is not prone to failure or intermittent operation resulting from vibration, droppage, weather exposure, temperature changes or other hard conditions of use.

Another object of the present invention is the provision of such a fused plug which is physically superior and not prone to being damaged or pulled apart during normal use.

Yet another object of the invention is the provision of such a fused plug incorporating fused lamps which lamps can be quickly and easily replaced by the consumer and which plug, in addition, permits the consumer to be provided with a clear indication of proper operation of the fused lamps.

Among other objects of the invention may be noted the provision of such a fused plug which has high intrinsic safety yet can be manufactured very economically and reliably; and which in general provides a very high degree of safety for the consumer.

Other objects and features will be in part apparent and in part pointed out in the following description.

BRIEF DESCRIPTION OF THE DRAWINGS

Corresponding reference characters indicate corresponding parts throughout the views of the drawings.

DESCRIPTION OF THE PREFERRED EMBODIMENT

Figure 1:
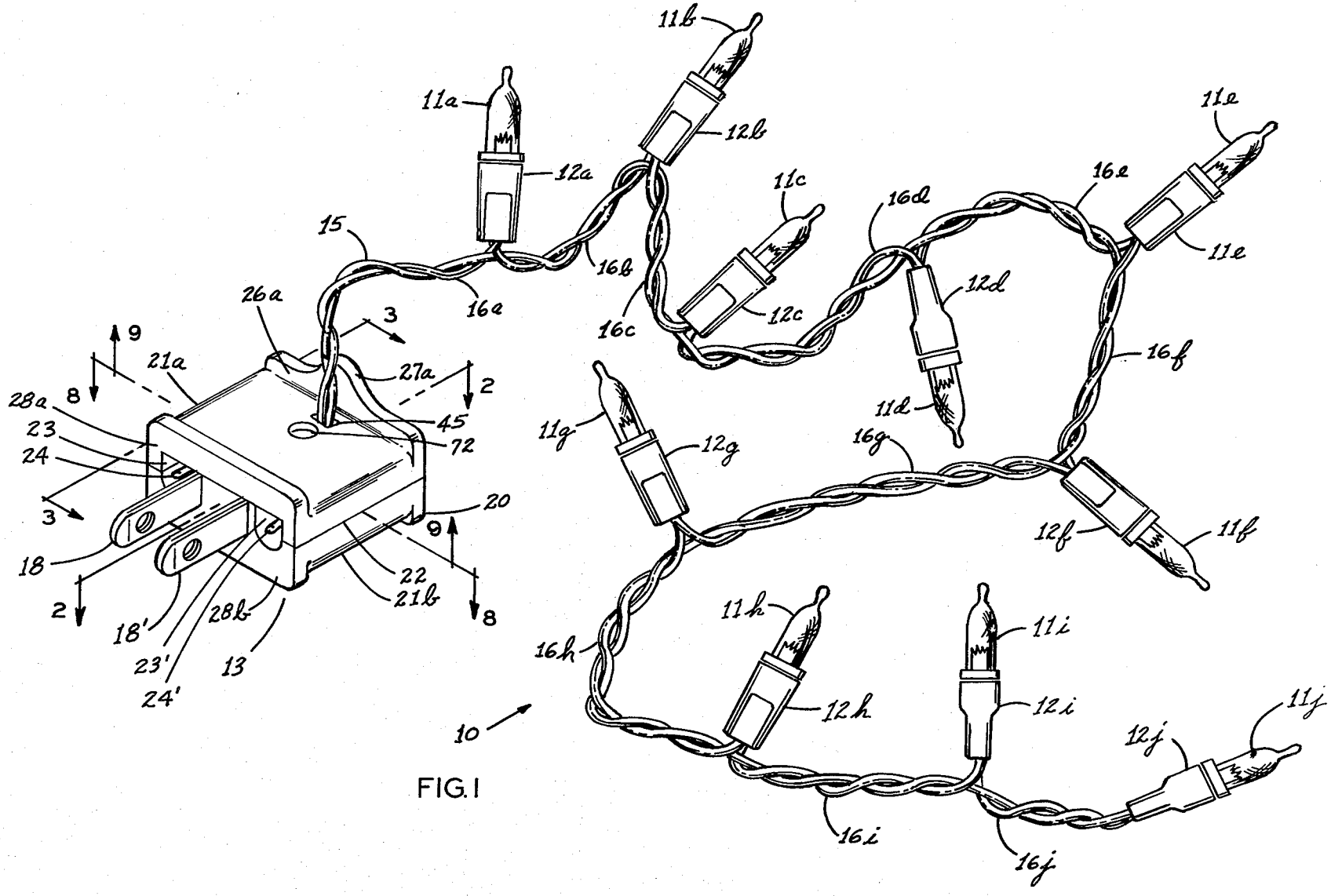
FIG. 1 is a perspective view pictorially representing a light string set including a fused plug constituting a safety lamp plug constructed in accordance with and embodying the present invention.

Referring now to the drawings, illustrated generally at reference numeral 10 is a light string set of the type having a plurality of miniaturized incandescent lamps, 11*a*, 11*b*, . . . , 11*j* in miniaturized respective sockets 12*a*, 12*b*, . . . , 12*j*. A fused plug 13 of a configuration according to the present invention is connected with said sockets and lamps by means of flexible insulated wire conductors 15 and 16*a*, 16*b*, . . . , 16*j*, providing a series circuit interconnection with prongs 18, 18' of plug 13. Prongs 18, 18' are configured to be received conventionally by a standard receptacle of the type providing household or utility a.c. power such as 115 volts.

For purposes of economy and lightweight construction, said conductors 15, 16*a*, etc. are of a relatively small gauge insulated wire, such as 24 gauge, sufficient to carry the current for illumination of the several bulbs 11*a*, etc. of the string set. Set 10 is of the type utilized for decorative purposes, as during holiday seasons, for use on Christmas trees and the like, and may be several feet in length, the number of sockets being subject to variation according to the manufactured length.

As will be understood, incandescent lamps 11*a*, through 11*j* may be of the shunt type wherein the filaments of the lamp have connected across them a shunt (not visible in the drawings) which is adapted to permit continued flow of current through the lamp if the filament should burn out. Although intended for holiday decoration, Christmas tree lighting, and the like, it is not intended that the present light string set be limited to such uses. However, in accordance with the invention, the current required by the incandescent lamps of light string set 10 will vary dependent upon the number of lamps, and size thereof, etc., as appropriate for an intended mode of usage. For example, with Christmas tree strings, the new fuse plug 13 may provide fusing for a series circuit current on the order of one ampere. Thus, in another usage, higher rated fusing, such as up to 3 to 5 amperes, may be provided by fused plug 13. Also, plug 13 may be used for providing fusing protection for other light electrical loads.

Fused plug comprises a housing or body 20 constituted by upper and lower portions or so-called halves 21*a*, 21*b* which are each of molded synthetic resin material, preferably polypropylene. Said upper and lower halves 21*a*, 21*b* are joined together along a line of separation 22 which generally bisects the plug to provide an axis of symmetry as the plug is viewed in FIG. 3. Said body halves 21*a*, 21*b* are, therefore, symmetrical about the axis defined by the separation line 22. The halves are joined together suitably, as by ultrasonic welding or by a rivet.

In accordance with the invention, there are contained within recesses or compartments 23, 23' respective fuse lamps 24, 24' which are so-called safety lamps. Said fuse lamps are each generally of the type described and claimed in Tong U.S. Pat. No. 4,030,059, entitled "Fuse", herein incorporated by reference. Said patent discloses a glass-enveloped fuse including a filament which is a fusible element which can melt to provide fusing operation if a current flow exceeds a predetermined amperage dependent upon the length and diameter of the filament. Although the fuse, or fuse lamp, disclosed in said patent includes a screw-in plug or base, it is preferred to employ in the present invention such fuse lamps wherein the base or the screw-in plug is omitted and the leads or electrodes of the fuse lamp instead extend straight down from the glass envelope.

Figure 3:
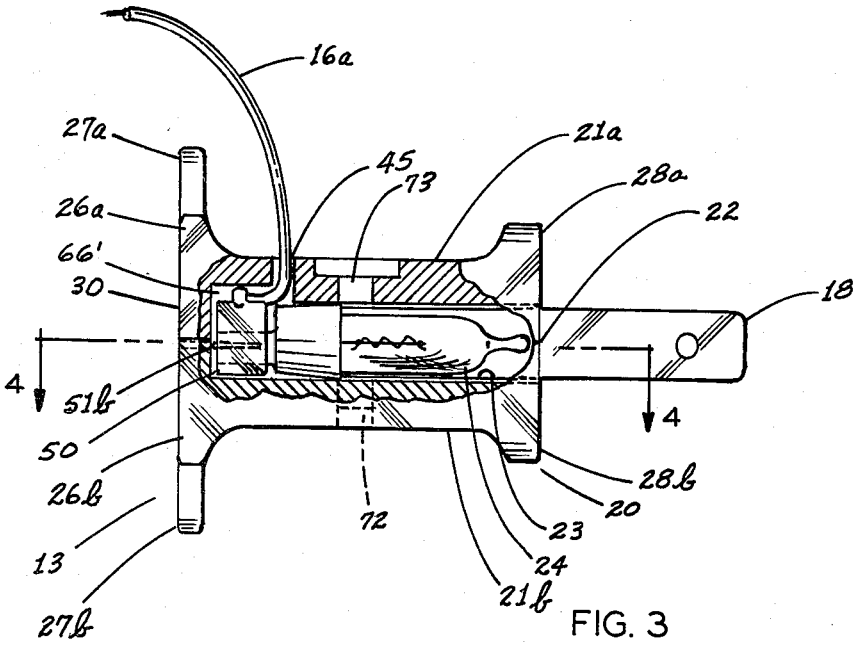
FIG. 3 is a side elevation of the safety lamp plug taken along line 3—3 of FIG. 1 and illustrating portions of the plug broken away to show internal features thereof.

Referring to FIG. 3, the thickness of plug body 20 is generally uniform in the central portion of the plug, but increases in the direction opposite from prongs 18, 18' to provide flanged portions 26*a*, 26*b* which diverge into tabs 27*a*, 27*b* of each half. Also, the portion of body 20 adjacent prongs 18, 18' is provided with increased thickness to provide flanges 28*a*, 28*b* of each half. Accordingly, the central portion of the plug body is effectively recessed for gripping by the user, and with flanges 26*a*, 26*b* and tabs 27*a*, 27*b* permitting superior gripping by the user for pulling the plug from a receptacle. Similarly, flanges 28*a*, 28*b* facilitate inserting the plug into a receptacle.

A relatively large, flat, area 30 is provided at the rear, or prong-remote end, of plug 20. Provided within said surface are a pair of plug slots 32, 32' for receiving the conventional prongs of an add-on plug, i.e., another plug to be added on and, thus, connected in tandem with plug 20.

Figure 2:
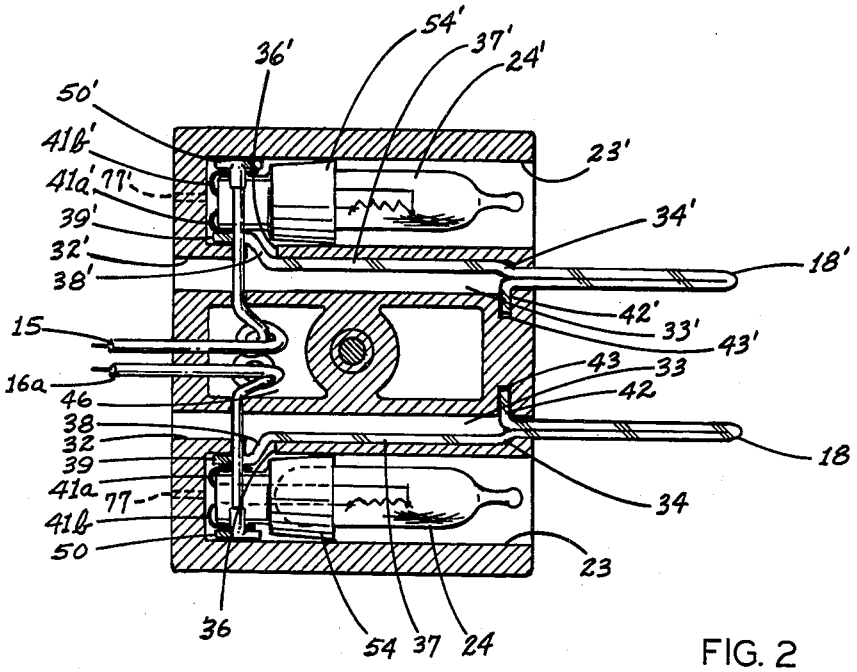
FIG. 2 is a transverse cross-sectional view of the new safety lamp plug taken along line 2—2 of FIG. 1.
Figure 8:
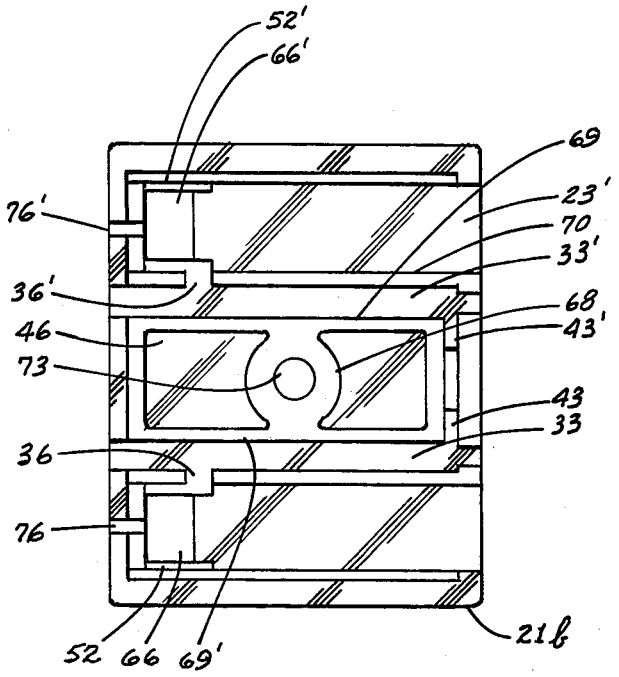
FIG. 8 is a plan view of the inside surface of a lower half of the plug body taken generally as indicated along line 8—8 of FIG. 1.
Figure 9:
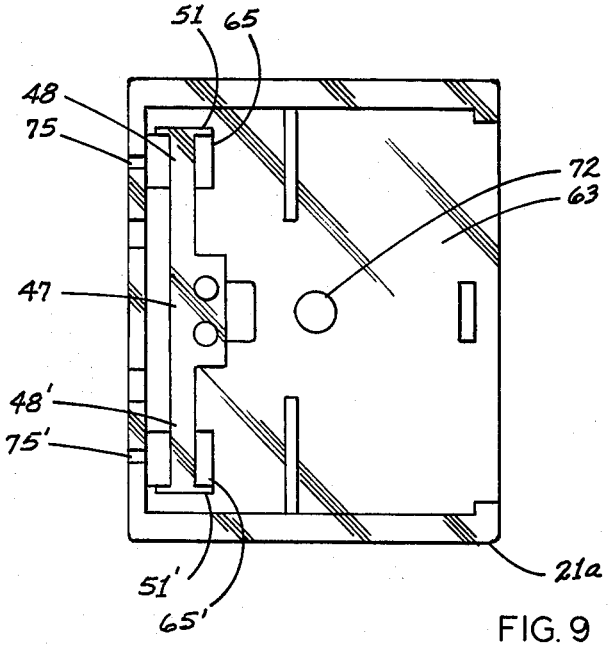
FIG. 9 is a plan view of the inside surface of an upper half of the plug body taken generally as indicated along line 9—9 of FIG. 1.

Referring now to FIG. 2 and also to FIGS. 8 and 9, plug halves 21*a*, 21*b* are interiorly provided with complementary features for defining therein said compartments 23, 23' as well as recesses or compartments 33, 33' for receiving respective electrodes 34, 34' which define said prongs 18, 18'. Said electrodes are each formed of a single length of conventional alloy electrode metal of the type having good electrical conductivity as well as a degree of resilience.

Each said electrode recess 33, 33' opens into respective fuse lamp compartment 23, 23' through a slot 36, 36'. Each of electrodes 34, 34' is provided with a respective straight portion 37, 37' which lies along the outer wall of the respective compartment 33, 33', extend substantially the major portion of length of the compartment between said slots 36, 36' and the prong-adjacent end of the slots for contacting prongs of an add-on plug. Diverging outwardly from the straight portions 37, 37' are respective jogged portions 38, 38' which extend through the respective slots 36, 36' and are then rebent parallel with the straight portions to provide terminal portions 39, 39' located within the respective fuse lamp compartments 23, 23' at their prong-remote ends for being contacted by a respective fuse electrode 41*a*, 41*a'*.

Each of prongs 18, 18' are formed of a length of the electrode 34, 34' folded back upon itself whereby the electrode material leaves and re-enters the plug body to provide respective lateral extensions 42, 42' which are seated within corresponding slots 43, 43' formed within the plug body. Extensions 42, 42' thus ensure that the prongs 18, 18' won't be pulled from the plug body during normal usage.

Conductors or leads 15, 16*a* enter the plug body through an aperture 45 and thence extend into a compartment 46 formed centrally within the plug body. Said leads then extend separately through a channel 47 formed within the upper half 21*a* of the plug body, which channel has two portions 48, 48' which extend over the prong recesses 43, 43' as well as the fuse lamp recesses 23, 23'. Connected at the ends of these recesses 48, 48' to leads 15, 16a are terminal blades 50, 50' for providing contact with the respective other electrode 41b, 41b' of each fuse lamp. Each said terminal blade fits within a respective recess 51, 51' and 52, 52' formed therefor in the plug upper half 21a, and plug lower half 21b, respectively.

Figure 7:
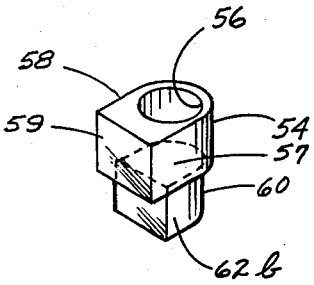
FIG. 7 is a perspective view of the fuse lamp holder.

The fuse lamps 24, 24' are fitted within corresponding fuse holders 54, 54' which are each of the configuration shown in FIG. 7. Each such fuse lamp holder contains a circular recess 56 which is closed at the bottom except for a pair of small holes extending therethrough for receiving the leads 41a, 41b of the fuse lamp. Said recess is formed within a base 57 which is provided with a lateral extension 58 having a flat side wall 59, there being a stem 60 of the lamp holder formed below said base 57. Said stem is of generally rectangular cross-section, the leads for the electrodes 41a, 41b extending therethrough and whereby there are provided flat surfaces, as at 62a, 62b, against which said fuse lamp electrodes 41a, 41b may lie when folded around the end of stem 60.

Referring to FIG. 8, said compartments 23, 23' are formed by corresponding recesses of FIG. 8, which recesses are of U-shaped cross-section, as exemplified by FIG. 1, but wherein the recesses are each provided with a flat wall provided by the flat interior surface 63 of upper half 21a. Also, raised lugs or shoulders 65, 65' are provided upon said surface 63 for accommodating the smaller stem 60 with its rectangular cross-section. Similarly, shoulders or lugs are provided at 66, 66' of the plug lower half 21b. It is also to be noted that the bottom half 21b is provided with a central boss 68, as well as webs 69, 69' and 70, 70' which define the electrode recesses 33, 33', which are closed by the flat surface 63 of the upper half 21a when the two halves are joined. Joinder is effected by a rivet or plastic stem extending through apertures 72, 73 of the lower and upper halves, respectively.

Figure 4:
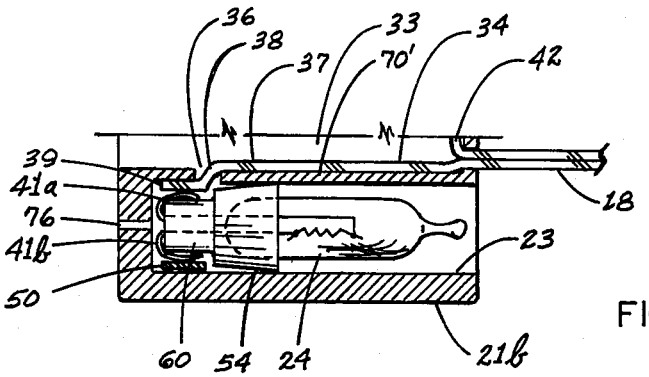
FIG. 4 is a transverse cross-sectional view of a portion of the plug taken along line 4—4 of FIG. 3.
Figure 5:
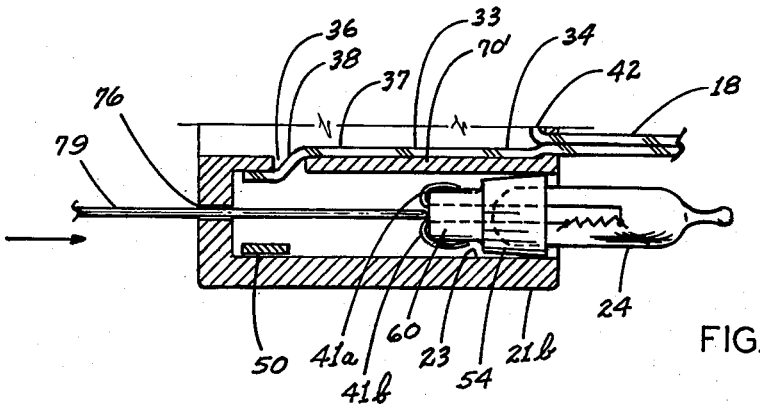
FIG. 5 is a transverse cross-sectional view similar to FIG. 4 but illustrating the removal of a fuse lamp and fuse lamp holder from the plug.
Figure 6:
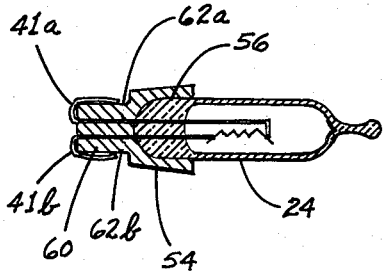
FIG. 6 is a cross-sectional view of a fuse lamp and fuse lamp holder employed in the invention.

In accordance with the invention, fuse lamps 24, 24' and their respective holders 54, 54' are slidably, removably receivable within compartments 23, 23', respectively. For this purpose, the cross-section of each of said compartments 23, 23' is uniform. Referring to FIGS. 4 and 5, each fuse lamp can be removed readily for being replaced by being slid outwardly, as seen by comparing FIGS. 4 and 5. For this purpose, the plug upper and lower housing are provided with grooves, as shown at 75, 75' and 76, 76' which align when the halves are joined to provide apertures 77, 77' opening from the rear of the plug into the respective fuse compartment 23, 23' in alignment with the stem 60 of each of the fuse holders 54, 54'. This small aperture permits one to insert a thin tool 79 such as a wire or an unfolded paper clip for contacting the stem 60 to push the fuse holder and its fuse lamp outwardly from its associated compartment 23, 23', thus ejecting same.

Because the fuse holder is provided with a flat surface 59 upon its base 57, the fuse lamp and fuse holder can only be inserted in the compartment 23, 23' in the correct orientation for causing the fuse lamp electrodes to contact the prong electrode portion 39, 39' and lead connector blades 50, 50'.

During normal operation, the user can observe both of the fuse lamps 24, 24' to glow. The illumination which emerges from the opening of each of fuse compartments 23, 23' can be observed by the user by slightly pulling the plug away from the wall of a receptacle in which the prongs 18, 18' are inserted. In this way, the consumer can be readily assured that proper fusing operation of each fuse lamp 24, 24' is correct. However, if the filament of either fuse lamp should melt so that the fuse lamp fails to operate, the consumer readily can remove the fuse lamp and replace it with one especially manufactured for replacement purposes, the shape of the fuse lamp recesses 23, 23' being such that only the correct lamp can be inserted therein.

Each fuse lamp remains in its own individual compartment to provide added safety so that, even in the unlikely event that a fuse lamp should explode, under no possibility could one fuse lamp cause injury or harm to the other fuse lamp. Further, the synthetic resin material, i.e., polypropylene, of the fuse plug body 20 provides a thermoplastic material which is not only strong but is flame retardant. Further, the various parts of the plug, i.e., the plastic halves 21a, 21b and electrodes 34, 34' may readily be produced in volume by automatic injection and stamping machines, so that they can be produced with very little labor, being easily and economically assembled.

In view of the foregoing it will be seen that the several objects of the invention and other advantages are achieved by the new constructions which have been described.

Although the foregoing includes the description of the best mode of the embodiments contemplated carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed and desired to be secured by Letters Patent is:

1. For providing fusing protection for a light string set or other like electrical load, a safety lamp plug comprising a body including a first pair of oppositely disposed compartments, respective prong-defining electrodes within said compartments for providing a pair of prongs extending from said body at one end, a second pair of oppositely disposed compartments within said body, and characterized by a pair of fuse lamps located within respective ones of said second pair of compartments, said body having apertures respectively proximate said prongs and opening respectively into said second pair of compartments, said fuse lamps each being slidably, removably receivable axially within the respective one of said second pair of compartments through said apertures for polarized connection in said sockets and for replacement, each of said fuse lamps having at one end only a pair of electrodes, integrally formed polarized sockets within said body for connection of said fuse lamps, said polarized sockets being remote from said apertures, each said socket including contact means for interconnecting each of said prong-defining electrodes with respective first ones of said fuse lamp electrodes and contact means for interconnecting a pair of circuit leads of a light string set or other electrical load with respective other ones of said fuse lamp electrodes, said apertures each permitting a person to observe illumination from the respective fuse lamp upon proper operation thereof, said second pair of compartments defining the first-said apertures and located within said body on opposite sides of said prongs in parallel relationship with said prongs, whereby each said aperture permits both observation of proper operation of the respective fuse lamp adjacent a corresponding prong without removal of the respective fuse lamp from said plug body and replacement of the respective lamp without disassembly of said fuse plug body but only after unplugging said prongs, said body including slots at the opposite end respectively opening into the first-said compartments for receiving prongs of an add-on plug at the opposite end of said plug, said prong-defining electrodes being adapted for providing electrical contact between the first-said prongs and said add-on plug prongs, said body having at said opposite end a pair of further apertures of reduced size relative to the first-said apertures and each oriented with respect to a respective fuse lamp for receiving a tool for ejecting the respective fuse lamp through a corresponding first-said aperture, said further apertures opening into said second pair of compartments on opposite sides of said add-on plug prong-receiving slots and being aligned longitudinally with the respective ones of said second pair of compartments and each adapted for receiving an elongated thin tool for ejecting the respective safety lamp from said body for replacement.

2. For providing fusing protection for a light string set or other like electrical load according to claim 1 and further characterized by each said fuse lamp having a glass envelope, a fuse lamp holder for holding said envelopes to present said electrodes for being contacted within the respective socket, each said fuse lamp holder having a cross-section shaped complementarily to said socket for being received in said socket only with a predetermined polarizing orientation, each said holder being slidable axially within a corresponding one of said second pair of compartments.

3. For providing fusing protection for a light string set or other like electrical load according to claim 2 and further characterized by the cross-section of each said fuse lamp holder and each said socket being defined by a curved portion and a flat portion to preclude rotation of each fuse lamp holder within its corresponding socket and whereby each said fuse lamp holder may only be received by its corresponding socket in a predetermined polarizing orientation.

* * * * *